United States Patent [19]

Erickson et al.

[11] 4,216,612

[45] Aug. 12, 1980

[54] TOY VEHICLE

[75] Inventors: Erick E. Erickson, Chicago; John R. Wildman, North Riverside; Burton C. Meyer, Downers Grove; Joseph M. Burck, Glenview, all of Ill.

[73] Assignee: Marvin Glass & Associates, Chicago, Ill.

[21] Appl. No.: 967,268

[22] Filed: Dec. 7, 1978

[51] Int. Cl.[3] ..... A63H 11/10

[52] U.S. Cl. ..... 46/103; 46/132; 46/251

[58] Field of Search ..... 46/97, 103, 99, 161, 46/160, 163, 123, 124, 127, 132, 206, 251

[56] References Cited

U.S. PATENT DOCUMENTS

| | | | |
|---|---|---|---|
| 545,958 | 9/1895 | Hoffmann | 46/132 |
| 2,696,695 | 12/1954 | Decker | 46/123 X |
| 2,760,303 | 8/1956 | Del Mas | 46/163 X |
| 3,093,929 | 6/1963 | Robbins et al. | 46/248 |
| 3,613,305 | 9/1966 | Suzuki | 46/206 |
| 4,068,401 | 1/1978 | Saitoh | 46/123 X |

FOREIGN PATENT DOCUMENTS

| | | | |
|---|---|---|---|
| 342510 | 12/1959 | Switzerland | 46/123 |
| 755810 | 8/1956 | United Kingdom | 46/103 |

*Primary Examiner*—Louis G. Mancene
*Assistant Examiner*—Mickey Yu
*Attorney, Agent, or Firm*—Mason, Kolehmainen, Rathburn & Wyss

[57] ABSTRACT

A wheeled vehicle having the appearance of an insect, such as a spider, includes a main body portion housing a drive mechanism for propelling the vehicle across a suitable supporting surface. The drive mechanism is shiftable for operating a cord winch for pulling the vehicle or drawing objects toward the mouth of the spider. A plurality of legs are mounted to the body portion by flexible couplings which permit the legs to engage the supporting surface so that they move randomly, during movement of the vehicle, to simulate a crawling action. A cockpit provided on the rear portion of the body is covered by a transparent shield and provided with indicia to define the control quarters of a mechanical spider device.

7 Claims, 8 Drawing Figures

10
2
156
158
160
110
12
16
22
18
20
14
110
2

150
154
C
16
156
152
160
158
12
18
14
130
140
134
138
136
66
56
58
82
26
106
80
106
106
36
34
30
3
3
84
70
60
64
52
50
54
42
44
28
38
24

A
70
62
74
64
48
52
68
66
56
50
54
46
60

B
102
88
90
32
36
104
34
36
96
102
30
104
100
80
92
94

Fig 3
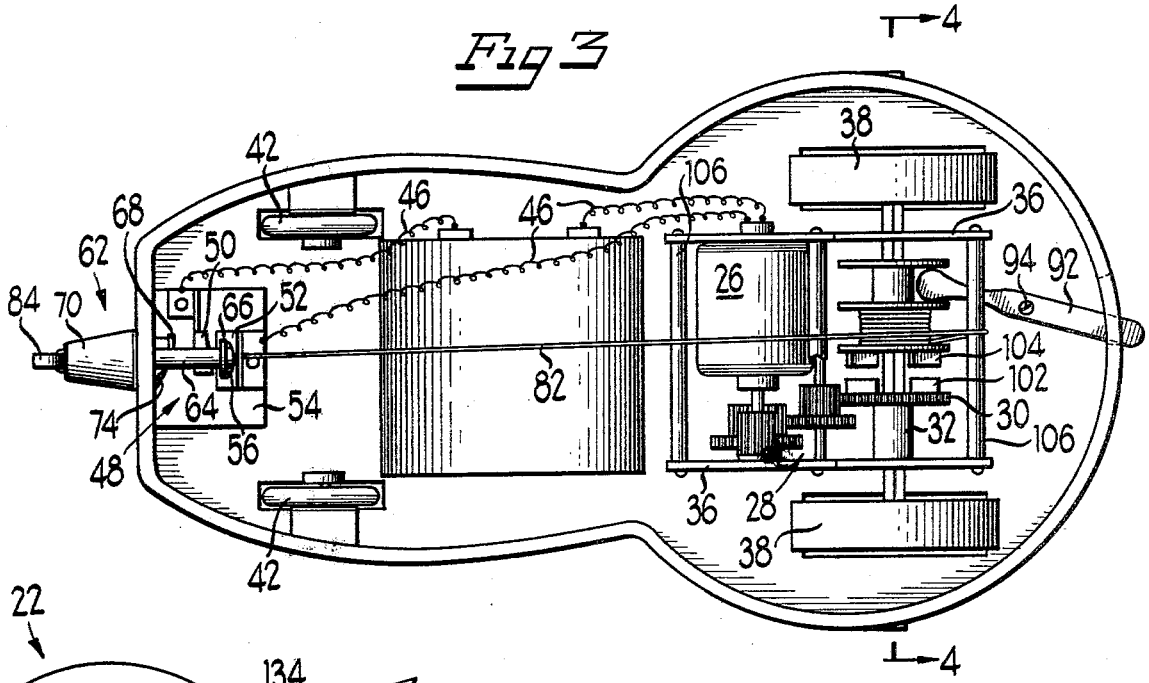
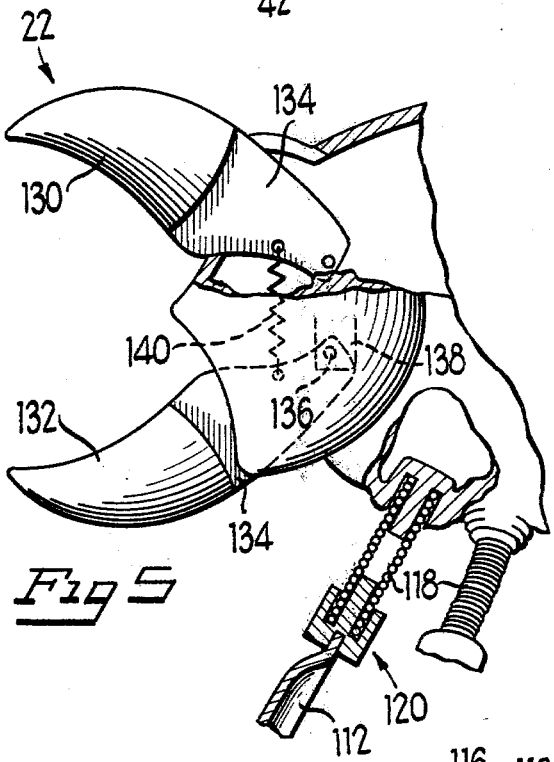
Fig 5
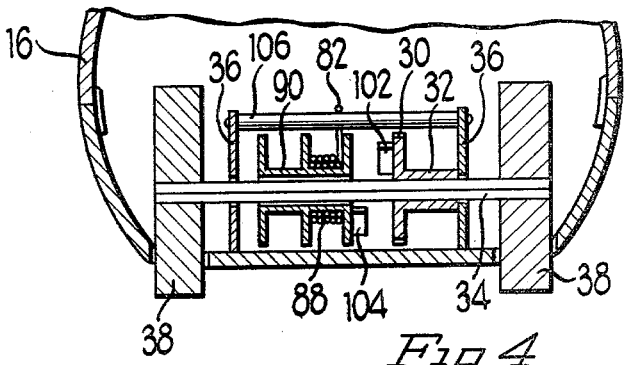
Fig 4
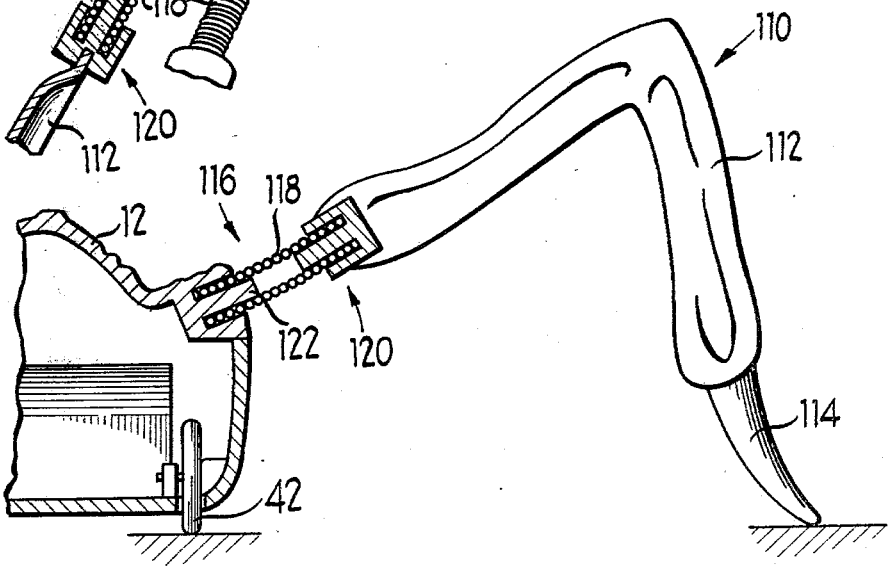
Fig 6

TOY VEHICLE

BACKGROUND OF THE INVENTION

1. Field of the Invention

The present invention relates to wheeled toy vehicle type devices and in particular to a vehicle formed in the shape of an animal or insect having various mechanical features representative of the actual creature.

2. Brief Description of the Prior Art

Various wheeled vehicles have been provided in the shape of an animal or other creature to provide entertainment and amusement for children. These types of devices are particularly interesting, and will maintain in child's attention, when prrovided with mechanical features which present a more life-like or realistic animal. U.S. Pat No. 4,114,310 discloses a toy fish which includes a winch type mechanism for capturing a smaller fish. U.S. Pat. No. 3,503,152 shows a pnematically operated walking toy forme generally in a shape to represent an insect.

SUMMARY OF THE INVENTION

The present invention provides a wheeled vehicle having the appearance of an insect, such as a spider, and includes a main body portion housing a drive mechanism for propelling the vehicle over a suitable supporting surface. The drive mechanism is selectively operable for movement to a second position to operate a winch which draws a tethering line into the vehicle, generally through the mouth area of the spider. The winch mechanism can therefore be used to draw objects toward the vehicle itself or to propel the vehicle up a very steep surface such as a net or wall. A plurality of legs are mounted to the body portion by flexible couplings which permit the legs to engage the supporting surface during movement so that the legs move randomly to simulate the crawling action normally associated with a spider. A cockpit area is enclosed by a pivoted, transparent cover and various instruments in the cockpit area define the control quarters of a mechanical spider device.

BRIEF DESCRIPTION OF THE DRAWINGS

FIG. 3 is a horizontal section, taken generally along line 3—3 of FIG. 2;

FIG. 4 is another vertical section taken generally along line 4—4 of FIG. 3;

FIG. 5 is a fragmented, partial section view of a claw-type mechanism of the present invention, FIG. 6 is a fragmented, partial sectional view of the mounting mechanism for one of the legs of the spider form of the present invention;

DESCRIPTION OF THE PREFERRED EMBODIMENT

Figure 1:
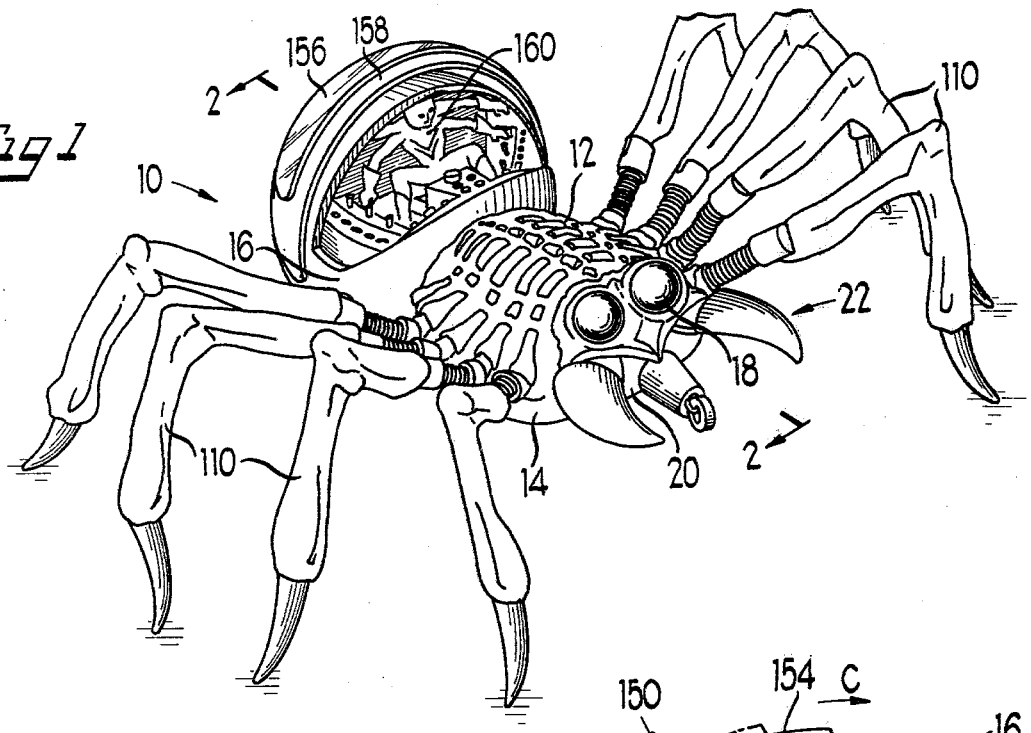
FIG. 1 is a perspective view of a toy vehicle made in accordance with the concept of the present invention.

Referring to the drawings, and in particular to FIG. 1, there is illustrated a toy vehicle, generally designated 10, made in accordance with the concepts of the present invention. Generally, the vehicle 10 is formed and shaped to resemble or represent a spider-like insect. The spider vehicle 10 includes a generally central body portion 12, a head portion 14 and a spherical tail or rear body portion 16. The head portion 14 includes at least a pair of eyes 18, a mouth 20 and a claw-type mechanism, generally designated 22. A power drive 24 is mounted generally within the rear torso section 16. The power drive 24 is utilized to propel the vehicle 10 over a suitable support surface and for operating a cord winch mechanism which will be described in detail hereinafter.

Figure 2:
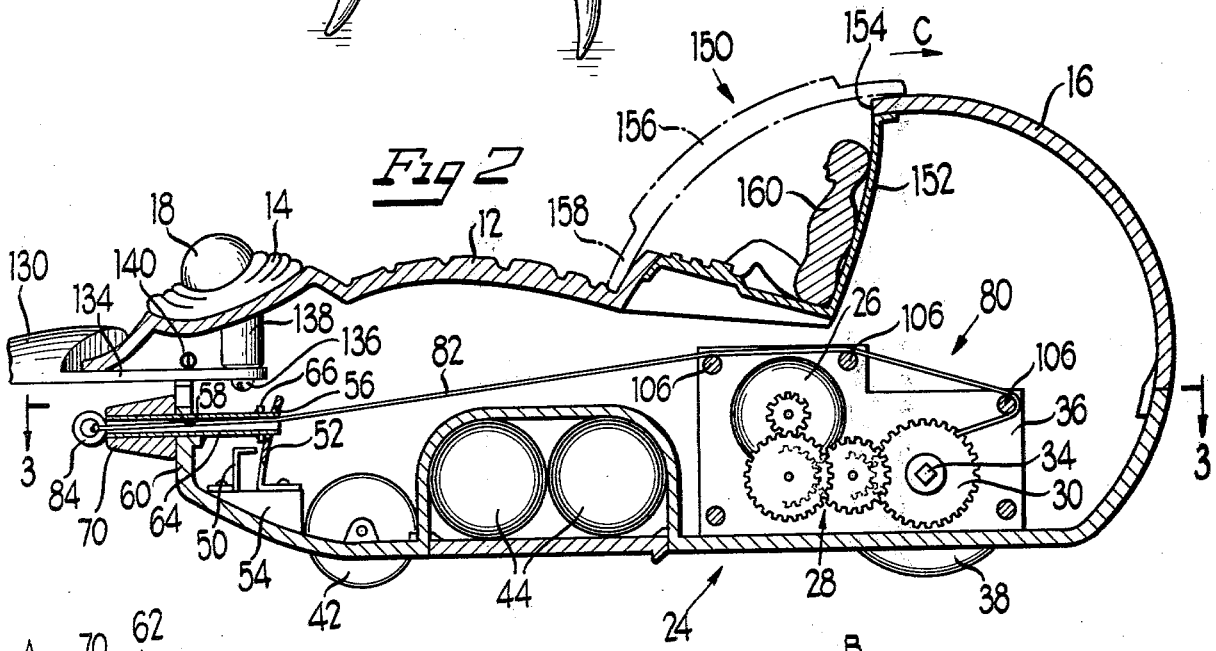
FIG. 2 is a vertical section, taken generally along line 2—2 of FIG. 1.

Referring more particularly to FIG. 2 and FIG. 3, the power drive 24 includes an electric motor 26 and a gear train 28 connected to an output gear 30. The output gear 30 includes an elongated shoulder portion 32 which is affixed to a square drive shaft 34. The drive shaft 34 is journalled between a pair of generally vertical plates 36 which serve to support the motor 26 and drive train 28 within the bottom portion of the rear torso section 16. A pair of support drive wheels 38 are mounted on the ends of the shaft 34 and extend through apertures in the bottom wall of the housing for driving the vehicle over a suitable supporting surface. Similarly, a pair of free wheeling front support wheels 42 are mounting generally below the head portion 14 extending through appropriate apertures in the bottom of the torso. The motor 26 is connected to a pair of batteries 44 by the wires 46 through a main power control switch generally designated 48. The batteries 44 provide a DC current for the motor 26 which drives the vehicle in a forward direction whenever the main switch 48 is made.

Figure 7:
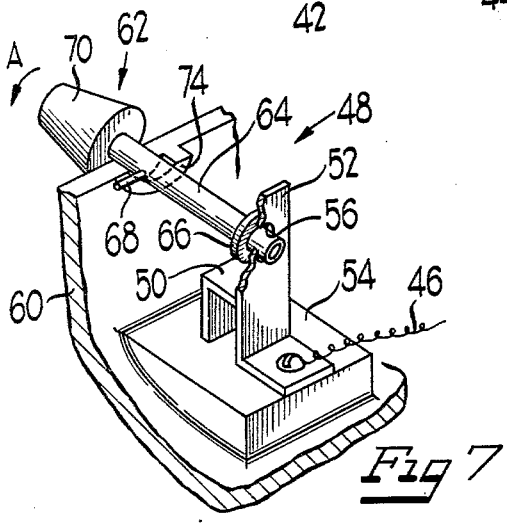
FIG. 7 is a fragmented, perspecttive view of the contact switch arrangement of the present invention.

The switch 48 is shown in perspective view in FIG. 7 to contain a stationary contact element 50 and a movable contact element 52, each of which are connected to respective leads 46 from the batteries to the motor 26. The contacts 50 and 52 are mounted to a support platform 54 which may be integrally molded with the bottom of the torso generally adjacent the mouth area 20 of the spider vehicle. The flexible contact includes a circular aperture 56 which is axially aligned with a similarly sized aperture 58 in a generally vertical front wall 60 of the housing. An actuator, generally designated 62, is mounted within the apertures 56 and 58. In particular, the actuator includes a hollow, cylindrical shaft portion 64 having a disc or shoulder 66 on the forward side of the movable contact 52 and a laterally extending pin 68 contacting the inside surface of the front wall 60. A generally turncated cone 70 is provided on the end of the shaft 64 to facilitate rotating thereof, as will be described in further detail. The pin 68 engages an arcuate camming surface 74 on the inside of the wall 60 so that, upon rotation of the cone 70 in the direction of arrow A, the pin will ride up to a higher point on the cam surface 74 thereby, through the shoulder 66, move the fliexible contact 52 away from the stationary contact 50 to the position as shown in FIG. 2. When the pin 68 is in its forwardmost position, as shown in FIG. 7, the flexible contact 52 engages the stationary contact 50 thus supplying power to the motor 25 of the power drive to propel the spider vehicle across a suitable relatively horizontal support surface.

The power drive 24 also serves to operate a winch generally designated by the reference numeral 80. The winch draws a cord or tethering line 82 through the apertured shaft 64 when the motor 26 is energized if the winch mechanism 80 is in its engaged position. A small ring 84 on the end of the tethering line 82 prevents passage of the end of the line through the shaft 64. In addition, when the line 82 draws the ring 84 into contact with the end of the truncated cone portion 70, continued tension on the line 82 moves the shaft 64 rearwardly and thus disengaging the contacts 50 and 52 to de-energized the motor, as described above with respect to the rotation of the shaft to disengage the contacts. Thus, it can be seen that the contact 52 will be flexed to the position as shown in FIG. 2 when sufficient tension is applied to the tethering line 82 or when the shaft 64 is rotated permitting the pin 68 to drive the shaft rearwardly with respect to the housing. This safety feature automatically de-energizes the motor 26 when the tethering line is completely drawn into the housing. The tethering line can be used for several purposes, such as drawing objects toward the mouth of the spider for simulated consumption or for drawing the spider vehicle 10 along a steeply inclined surface when the power drive of the wheels 38 do not have enough frictional forces.

The winch 80 is selectively operable as described below with respect to FIGS. 3 and 8. In particular, the winch 80 includes a spool 88 which is freely rotatably mounted on the square shaft 34. In addition, the spool 88 is conjointly rotatably mounted with a shifter spool 90 for selective operation of the winch. A shifting arm 92 is pivotally mounted by a securing screw 94 adjacent the rear of the housing so that a portion of the lever 92 extends through a slot within the housing. The forward end of the lever 92 includes a circular portion 96 which rides between the flanges of the shifter spool 90 for moving the spool laterally along the shaft 34 as the lever is pivoted.

Figure 8:
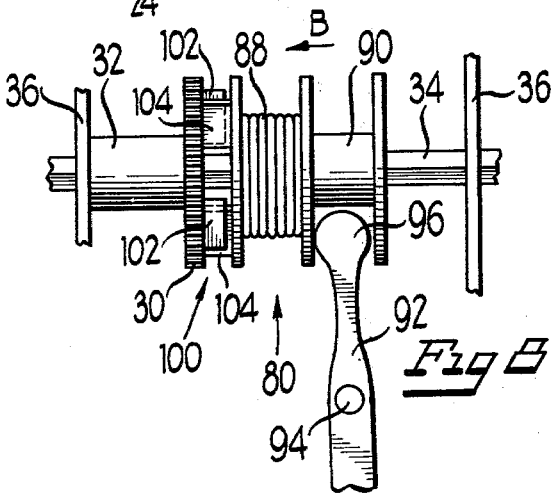
FIG. 8 is a top plan view of the selectively operable shifting mechanism of the drive system.

A clutch mechanism 100 is selectively engaged to operate the winch when the lever 92 is pivoted to the position as shown in FIG. 8. Specifically, the clutch mechanism 100 includes a plurality of transversely directed tabs 102 on the output gear 30 and a similar plurality of tabs 104 on the flange of the spool 88 adjacent the output gear. Therefore, when the spool is shifted, referring to FIG. 8, to the left as shown by arrow B, the tabs 102 and 104 contact one another thus driving the spool 88 in the same direction as the shaft 34 and drive wheels 38. The tethering line 82 is stretched across the top spacers 106 between the side walls 36 and wraps across the top of the spool 88. As described above, withdrawing the tethering line 82 all the way into the housing causes the motor 26 to automatically become de-energized. When it is desired to extend the tethering line, the lever 92 is merely shifted to the right, as shown in FIG. 8, to release the clutch mechanism 100 and permit the line to be manually withdrawn from the spool.

Several additional features add to the lifes-likeness of the spider vehicle 10. In particular, referring to FIGS. 1, 5 and 6, the present invention discloses a spider-like insect having eight legs 110, four of which are mounted on either side of the central torso portion 12. Each leg 110 includes a generally L-shaped central portion 112, a tapered end or claw 114 and a flexible joint, generally designated 116, which connects the legs to the torso. More particularly, the flexible connection includes a predetermined length of generally tightly coiled spring steel 118. The opposite ends of the spring 118 are secured to the torso and the central leg portion 112 by similarly shaped seats 120. Each seat 120 includes a cylindrical shaped void about an extending pin or probe 122 which may be dimensioned to frictionally mount the elements together or be assisted by a suitable adhesive material. As seen more clearly in FIG. 5, the seat 120 of the leg portion is shown to be a separate element while the seat on the torso is formed integrally therewith. The flexible connection 116 is formed at an angle to support the leg 110 such that, the weight thereof, causes the claw portion 114 to engage and bear down slightly on the support surface upon which the wheels 30 and 42 are resting. As the motor 26 is energized to drive the vehicle across the surface, the pointed ends of the claws 114 will drag across the supporting surface causing the leg to move slightly as the spring 18 flexes while the static friction at the contact point of the claw prevents sliding of the claw relative to the surface. However, after some movement of the main torso portion, the static friction will be overcome permitting the leg 110 to spring forwardly under the biasing force generated within the flexible connection 116 and generally, to a point slightly forward of an equilibrium position of the spring due to the momentum of the leg. The combined effect of each of the legs intermittently or randomly moving under the biasing forces of the springs 118 causes the spider to provide a very realistic simulated crawling action normally associated with such a multi-legged insect.

The claw-like structure 22 is shown in FIGS. 2 and 5 to include a pair of generally arcuate shaped claws 130 and 132, disposed generally symmetrically about the center line of the spider. Each of the claw elements 130 include a rearwardly directed generally flat extension 134 which passes through an aperture defined by the bottom of the head and the top of the front wall 60. The ends of each of the extensions 134 include an aperture which serves as a pivot point about a screw 136 mounting each of the claws to a depending tab 138. Thus, the claws are mounted for pivotal movement and a biasing means in the form of a spring 140 biases the two elements toward a central, normal position, as shown in FIG. 1, when a suitably sized object is secured and drawn in by the tethering line 82, its contact with the ends of the claws 130 and 132 simulate a grasping thereof by the spider.

An additional feature, as shown in FIGS. 1 and 2, is provided in the form of a control station, generally designated 150, at the forwardmost portion of the rear torso section 16. More particularly, a generally L-shaped support wall 152 is mounted within a segmental aperture 154 to provide a control station. Preferably, the wall 152 is formed with a plurality of simulated dials, knobs, and other control indicia similar to the cockpit of a plane or other fairly sophisticated weapon or artillery device. The control station is covered by a pivotally mounted arcuately shaped, transparent shield 156 mounted within a similarly shaped, larger frame 158. The frame 158 is pivoted so that, in its withdrawn position, after movement thereof in the direction of arrow C (FIG. 2), the shield overlies the rear of the torso portion 16 as shown in FIG. 1. In the preferred embodiment, a suitably sized figure toy 160 is mounted within the control station to simulate the operator of the mechanical device to provide additional entertainment for the user.

The foregoing detailed description has been given for clearsness of understanding only and no unnecessary limitations should be understood therefrom as some modifications will be obvious to those skilled in the art.

What is claimed is:

1. A toy vehicle, generally in the form and shape of a spider, comprising:

a hollow torso portion having a head on its forwardmost end;

a selectively operable drive means within the torso for propelling the same across a suitable supporting surface;

a selectively operable winch means having an extendable tethering line for connection to an object and to provide relative movement with the vehicle upon operation thereof;

a tail portion secured to the end of said torso opposite said head including means defining a cockpit area for an operator of the vehicle and a movably mounted transparent element closing a generally forwardly directed open portion of said tail;

means defining a plurality of extremities for the spider figure; and flexible connection means between the extremities and said torso, said flexible connection means being sized according to the mass of the associated extremity to allow a portion of the weight thereof to be supported on the support surface whereby relative movement of said vehicle with respect to the support surface means the extremity in a realistic manner.

2. The toy vehicle of claim 1 wherein said winch means includes a switch for de-energizing said winch means to disable the same in response to tension generated in said tethering line.

3. The toy vehicle of claim 1 or 2 wherein said flexible connection means comprises a flexible element of very short length relative to the overall length of the extremity.

4. The toy vehicle of claim 3 wherein said flexible connection means comprises a relatively rigid coil spring element removably mounted by opposing posts on the torso and the respective extremity.

5. The toy vehicle of claim 4 including a plurality of wheels for rotatably supporting the body and transmission means interconnecting said drive means with said wheel means to provide said movement.

6. The toy vehicle of claim 5 including a pair of pivotally mounted claws having biasing means for urging the claws towards one another.

7. The toy vehicle of claim 6 wherein said switch means has two operational modes, the selectively operable mode and a second, winch operable mode.

* * * * *